United States Patent [19]

Peterson et al.

[11] Patent Number: 4,723,374

[45] Date of Patent: Feb. 9, 1988

[54] CANTILEVERED SLIDING GATE

[75] Inventors: Douglas C. Peterson, Saratoga Springs; Kenneth C. Fischer, Burnt Hills; Richard E. Dawson, III, Shushan; Peter J. Smith, Gansevoort, all of N.Y.

[73] Assignee: The Tymetal Corporation, Inc., Schuylerville, N.Y.

[21] Appl. No.: 63,775

[22] Filed: Jun. 24, 1987

Related U.S. Application Data

[63] Continuation of Ser. No. 819,234, Jan. 15, 1986, abandoned.

[51] Int. Cl.[4] ..... E06B 11/00

[52] U.S. Cl. ..... 49/404; 49/394; 52/291; 52/227

[58] Field of Search ..... 49/396, 400, 404, 445, 49/447, 501; 52/291, 227, 229

[56] References Cited

U.S. PATENT DOCUMENTS

| | | | |
|---|---|---|---|
| 959,576 | 5/1910 | McCloud | 52/227 |
| 983,681 | 2/1911 | Buttlar | 52/227 |
| 1,368,222 | 2/1921 | Foreman | 52/227 |
| 2,644,554 | 7/1953 | Katz | 49/400 |

FOREIGN PATENT DOCUMENTS

| | | | |
|---|---|---|---|
| 0627405 | 10/1927 | France | 52/291 |
| 0034593 | 9/1929 | France | 52/291 |

OTHER PUBLICATIONS

"Anchor Fence", Products & Story, Anchor Post Products, Inc., 1978, pp. 1-24.

*Primary Examiner*—Peter A. Aschenbrenner
*Assistant Examiner*—Gerald A. Anderson
*Attorney, Agent, or Firm*—Kenyon & Kenyon

[57] ABSTRACT

A cantilevered sliding gate made up of a number of panels is disclosed. The panels are joined by post-tensioning rods, carried within horizontal members of the gate and extending substantially the length of horizontal members of the gate. During gate assembly, a tensile stress is induced in the post-tensioning means, which stress is transmitted to the horizontal member as a compressive stress. The resulting stress pattern results in a stiffening effect on the gate assembly, permitting lighter-weight construction than previously possible. The gate is mounted on vertical supports for movement in a plane defined by the supports.

14 Claims, 6 Drawing Figures

90
82
86
80
88
28
88
90
84
44
49
85
92
94
94

CANTILEVERED SLIDING GATE

This application is a continuation, of application Ser. No. 06/819,234, filed Jan. 15, 1986, now abandoned.

BACKGROUND OF THE INVENTION

The present invention relates to the field of gates, and more particularly to the field of cantilivered sliding gates.

Gates, of course, have been known since extremely ancient times, but few advances in their basic design have been made. A primary effort has been directed toward reducing the space that must be allocated for the typical swinging gate. A first-order solution to that problem substitutes a sliding member for the conventional swinging member, but a difficulty immediately arises in supporting the sliding member. Overhead support is only suitable when an overhead obstruction is permissible; clearly, roadways and the like where vehicles will pass are not amenable to this solution. Support from below also is possible, either by a track mechanism or a gate-mounted roller, but uneven surfaces and the possibility of obstructions, such as ice and snow, subtract from the utility of that approach.

As early as the beginning of this century, it was proposed to cantilever a gate across an opening, permitting a sliding gate, able to span a gap yet not requiring support either from above or below. U.S. Pat. No. 1,020,488, to Friend, discloses the basic design for such a concept. There, it can be seen that two vertical supports are provided, one immediately adjacent the gap and another spaced a distance away from it, with the gate being mounted to slide in a plane defined by the two vertical supports. The most important problem associated with cantilever structures, i.e., preventing downward deflection or sag in the far end of the cantilever beam, is addressed by a guy wire assembly. A prior reference to Anderson, U.S. Pat. No. 920,810, discloses much the same construction but without the guy wire assembly. Even so, the disclosure states that the assembly would sag but for provision of a triangular brace structure which absorbs much of the stress transmitted through the structural members. In both disclosures, the structural members are preferably iron pipe.

Over the years, improvements have been presented that eliminate some of the operational problems of this type device. For example, a significant problem relates to the use of exposed rollers as means for allowing the gate to slide. Such devices are highly susceptible to adverse weather conditions, particularly ice and snow, and over time they tend to become clogged with dirt and debris, degrading their movement. Also, they tend to move out of alignment over time, further impeding the easy movement of the gate. A solution to that problem was included in U.S. Pat. No. 3,531,895, which disclosed a vertical gate including a slide assembly riding in an enclosed track on the gate member. Also, U.S. Pat. No. 4,336,670, to Brutosky, suggested a telescoping mechanism that obviated the need for a "counterweight" section of the gate extending beyond the secondary support post when the gate was in the retracted position.

Notwithstanding these improvements, however, significant problems remain in this field. Primarily, such gates normally are constructed as single-piece units. That is, the upper and lower transverse members are fabricated as single pieces of tubular steel or aluminum.

Thus, state-of-the-art devices, such as produced by the Anchor Post Company, of Baltimore, Md., and International Gate Devices, Inc., of Folsom, Pa., all see the necessity of long, relatively heavy transverse members to cope with the stress inherent in a cantilever device. The disadvantages of this approach are manifest. For example, such long, cumbersome structures are difficult and expensive to transport. Further, they require special care in installation, and if damaged, they cannot be repaired easily in the field.

Moreover, another serious problem appears when one attempts to construct such a wide gate, in that the downward-directed forces result in a twisting moment, producing a camber at the end of the gate. The art's only solution to this problem has been to add stiffening materials to the gate, exacerbating the weight, installation and transportation problems. Indeed, for relatively wide gates, the only solution has been to construct the gate in a so-called "box-spring" design, employing two complete gate structures in a side-by-side structure, connected by struts.

Thus, the time is ripe for a new approach to this problem, one that allows for ease of use and maintenance, without sacrificing stability.

SUMMARY OF THE INVENTION

It is therefore an object of the present invention to provide a cantilevered gate having light weight and significantly greater rigidity than products available according to the prior art.

Another object of this invention is to produce a cantilevered gate having a multi-panel form of construction, allowing users to assemble the gate quickly and easily at the installation location.

A further object of this invention is to provide a cantilevered gate that can be transported in relatively small vehicles, such as panel or pickup trucks.

Yet another object of this invention is a cantilevered gate that can be repaired at the user site by user personnel.

Still another object of the present invention is to provide a cantilevered gate having sufficient stability to span a gap of up to 40 feet in width.

Also, it is an object of this invention to provide a cantilevered gate which mitigates the tensile forces imposed during use by applying a compressive force to the horizontal structural elements of the gate, during its assembly.

A further object of the present invention is to provide a cantilevered gate that avoids camber without adding material.

These and other objects are achieved by the present invention, which includes a gate assembly carried by support means. In a preferred embodiment, the support means includes two vertical posts adjacent to the gap to be spanned and both located on the same side thereof, the two supports defining a closure plane across the gap. The gate may be carried on the support members by slidable means such as a truck assembly including bearing wheels for allowing free sliding movement, with a guide roller assembly for maintaining the gate oriented parallel to the closure plane.

The gate member of the invention preferably includes panels, which are assembled into a relatively long gate at the user site. By manufacturing panels in standard sizes, a relatively small number of such standard panels could allow a user to construct a gate in any one of a number of different widths.

Structural rigidity is obtained by post-tensioning at least one horizontal member of the gate. That is, means are provided for applying a compressive force to these components before the gate is erected. In a preferred embodiment of the invention, the post-tensioning means is a threaded, tubular member carried in the upper and lower gate horizontal members, which tubular member can exert compressive force by threading bolts on the end of same, these bolts bearing on the ends of the horizontal members by means such as an end plate. When the bolt is taken up, the tubular member is placed in tension, which is transmitted to the horizontal member through the end plate as a compressive force. So long as the applied compressive force, plus any force imposed by loading, does not exceed the failure strength of the material, then the upper portion of the horizontal member cannot go into tension itself until the large compressive force is overcome. Thus, the gate is greatly stiffened compared to gates constructed according to the teaching of the prior art.

Although the preferred embodiment is a cantilever sliding gate, other gate types can be constructed according to the present invention.

DETAILED DESCRIPTION OF A PREFERRED EMBODIMENT

Figure 1:
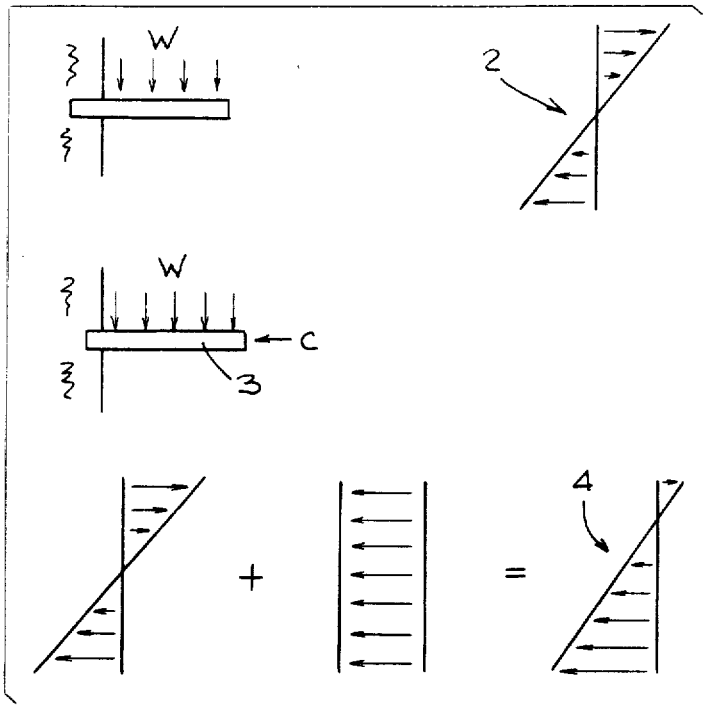
FIG. 1 is a diagrammatic representation of the principle upon which the invention is based.

Understanding of the present invention will be facilitated by considering some basic principles, illustrated in FIG. 1. Consider the cantilever beam 1, whose weight is graphically depicted as the downward-thrusting arrows W. That beam will exhibit stress characteristics as shown in stress diagram 2, with the neutral plane located approximately in the center of the beam, with tensile stresses located above the neutral plane and compressive stresses below it. Compare that beam with beam 3, whose weight again is shown by arrows W, but with the addition of a compressive force C bearing axially against the end of the beam. Stresses within that beam will be as shown in diagram 4, with one set of stresses being identical to those shown in diagram 2, plus a set of compressive stresses imposed by the force C. Adding these stresses by superposition, the resultant stress pattern shows a very small net tensile force, exerted only in the extreme upper portion of the beam, the remainder of the stresses being compressive. Clearly, the end of beam 3 will be subject to considerably less downward deflection than is the end of beam 1.

These diagrams graphically illustrate the point that one can in effect add a measure of stiffening to a beam by increasing the compressive forces acting upon it. It will be familiar to those in the art, of course, that a designer must insure that the aggregate compressive forces do not exceed the yield strength of the material involved.

Figure 2:
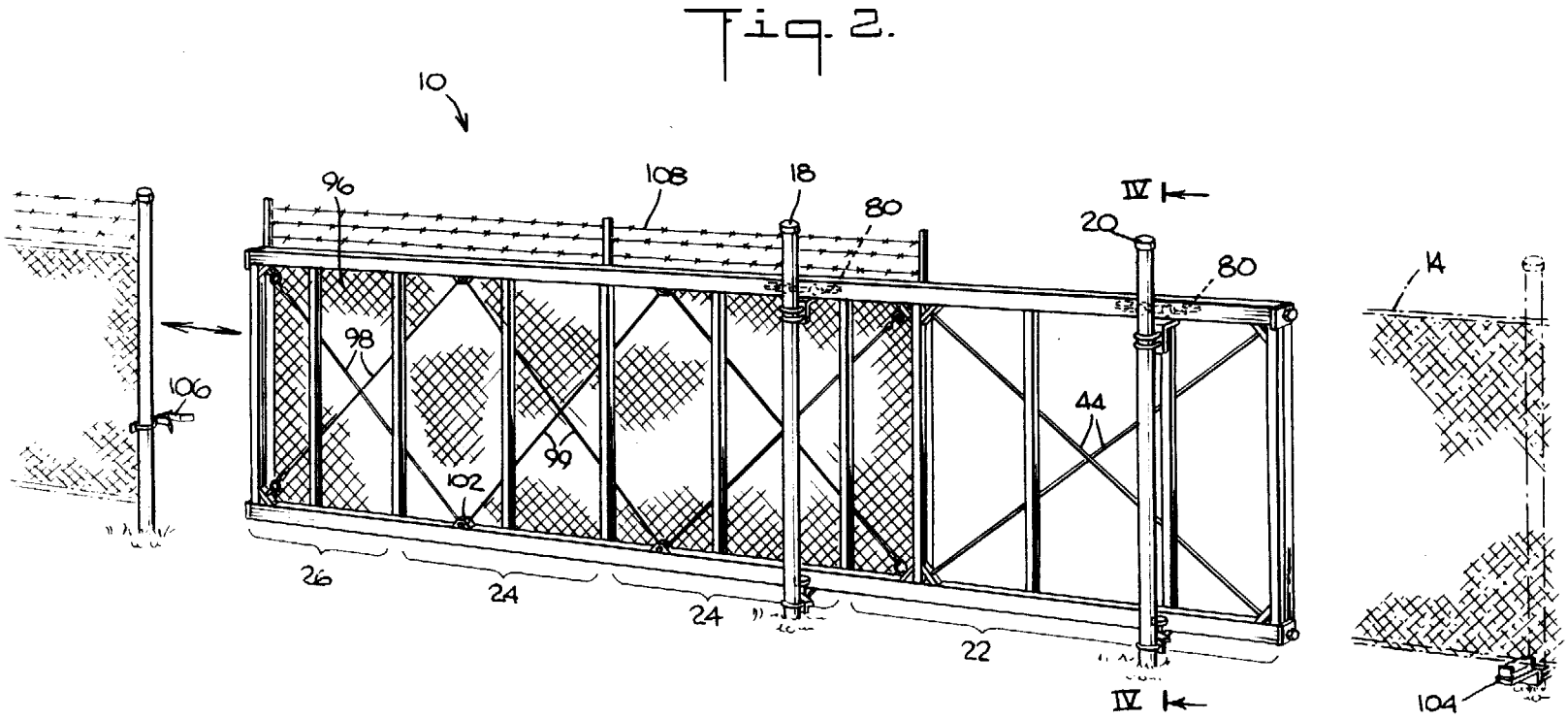
FIG. 2 is a perspective of a gate constructed according to the present invention.

A preferred embodiment 10 of a cantilevered sliding gate constructed in accordance with the present invention is shown in FIG. 2. As seen there, the general environment for the invention includes a gap to be spanned—typically, a roadway—and a perimeter fence 14, often of the chain-link variety. The gate extends laterally from one side of the gap, hereinafter referred to as the "gate side". Of course, one can span gaps wider than the maximum length of the gates described herein by providing one gate assembly on each side of a gap, operating in opposite directions.

The gate is carried by support means, preferably two vertical support members, with a primary vertical support 18 located adjacent to the gap, and a secondary vertical support member 20, spaced further back from the gap and from the primary member. These two supports define a plane, extending in one direction along a portion of the perimeter fence and in the other direction across the gap. Construction and operation of the support members will be discussed in greater detail below.

Figure 3:
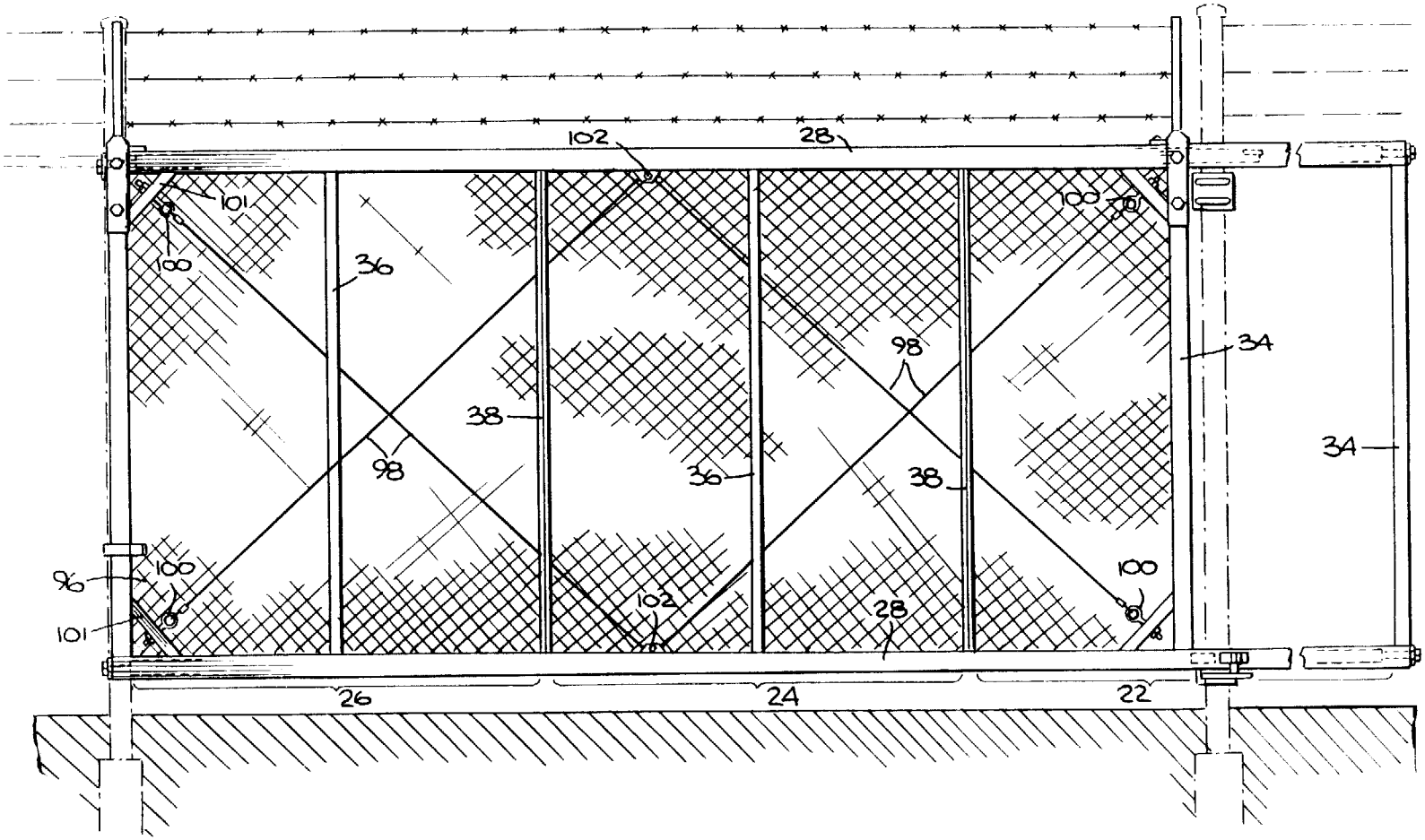
FIG. 3 is a front view of a gate constructed according to the present invention.

The gate assembly means itself can be described as including several different types of panels, joined together in a manner described below, to make up a complete gate, as seen in FIGS. 2 and 3. The types of panels can be defined by their function and by their construction. Generally, any complete gate will include a counterbalance panel 22, one or more spacer panels 24, and an end panel 26. The counterbalance panel performs the function of supporting the gate in its fully closed position. When the gate is fully closed, the counterbalance panel extends approximately from the location of the primary vertical support at least to and overlapping the secondary vertical support.

The end panel is located at the opposite end of the gate, with spacer panels placed between it and the counterbalance panel. It will be appreciated that by supplying such panels in a relatively small number of standard widths, a variety of gates can be fabricated for different size gate openings. Note, for example, that the gate shown in FIG. 2 is longer than that depicted in FIG. 3, the former including two spacer panels. This fact presents an important advantage of the instant invention, in that the prior art necessitates a choice between either custom-ordering a gate, entailing long delays, or limiting the buyer to a few sizes.

A single type of horizontal member and several types of vertical members are assembled in various combinations to produce the three panel types. In cross-section, seen in FIG. 4, horizontal member 28 consists of two portions. One portion generally has the form of a square box section, having a central passage 30. A second portion is a mounting leg 32, extending normal to one of the faces of the square and located at one end of a face, so that one of its sides forms an extension of the square portion. The member thus exhibits the general shape of the letter "P". A receiver face 40 occupies the remainder of the face of the square section from which the mounting leg extends. Horizontal members are located at the top and bottom of each panel.

Vertical members can take the form of end members 34, support members 36, or spacer end members 38 as seen in FIG. 3. End members are generally formed having a square box section, compatible in appearance to the square portion of the horizontal member. Support members are square in cross-section, with each side of the square slightly smaller in length than the receiver face 40 on the horizontal member. Spacer end members are rectangular; their shorter sides have half the length of corresponding sides of support members.

The various vertical members can be combined with horizontal members to form the three panel types in the following manner. The counterbalance section 22 shown in FIGS. 2 and 3 has an end member 34 at one end, a spacer end member 38 at the opposite end, support members 36 spaced at intervals therebetween, and an end member 34 adjacent to and inside the spacer end member. For longer gates, of course, longer counterbalance sections are fitted with differing arrangements of vertical members, such as additional support members. Diagonal support members 44 may be added to the counterbalance section for additional stability.

The end section 26 has an end member 34 at one end, a spacer end member 38 at the other end, and support members 36 disposed therebetween. Spacer panels 24 have spacer end members 38 at both ends, with support members 36 between them. It will be appreciated that when spacer panels are abutted either to another spacer panel, an end panel or a counterbalance panel, the reduced thickness of the spacer end member allows the joined members to present a visual impression identical to that of a support member; thus, the completed gate does not give the appearance of an assembly of panels, but rather of a unitary structure.

Any suitable material can be employed to fabricate the various horizontal and vertical members, but it is preferred to employ extruded aluminum sections. Aluminum offers advantages of light weight, high strength, and good machinability, particularly compared to high-weight products such as steel. It has proven convenient to produce the end members having two-inch square sections, matching the square portion of the horizontal member. Support members may have a one-inch square section, with spacer end members a section ½ inch by 1 inch. All types of vertical members extend between horizontal members mounted at the top and bottom of the gate assembly, as shown. Preferably, all vertical members are located on two-foot centers. It will be appreciated that a customer desiring a gate having a "picket-fence" appearance could easily obtain additional support members and could quickly and conveniently secure them in place, for example, with rivets, on the spacer and end panels, producing a gate with a denser concentration of vertical members in the area of the gate extending across the gap.

In the embodiment shown, it is preferred to produce counterbalance panels in 10 and 12 foot widths, end panels in 6 foot widths, and spacer panels in 6 foot, 8 foot, and 10 foot widths. It has also been found convenient to provide sections with nominal heights (the height from ground level) of from four to twelve feet. Thus, one can combine these sections to obtain gates having nominal widths (that is, the width of the gap to be spanned) of from 8 feet to 40 feet, the latter being the outer structural limit of the embodiment disclosed, but not necessarily the widest possible gate that could be fabricated employing the present invention.

Initial assembly of the gate proceeds by selecting the particular panels to be employed and securing the panels together. As will be seen, this securing step is preliminary, and can proceed by any means suitable, such as by bolting the various panels together.

Figure 4:
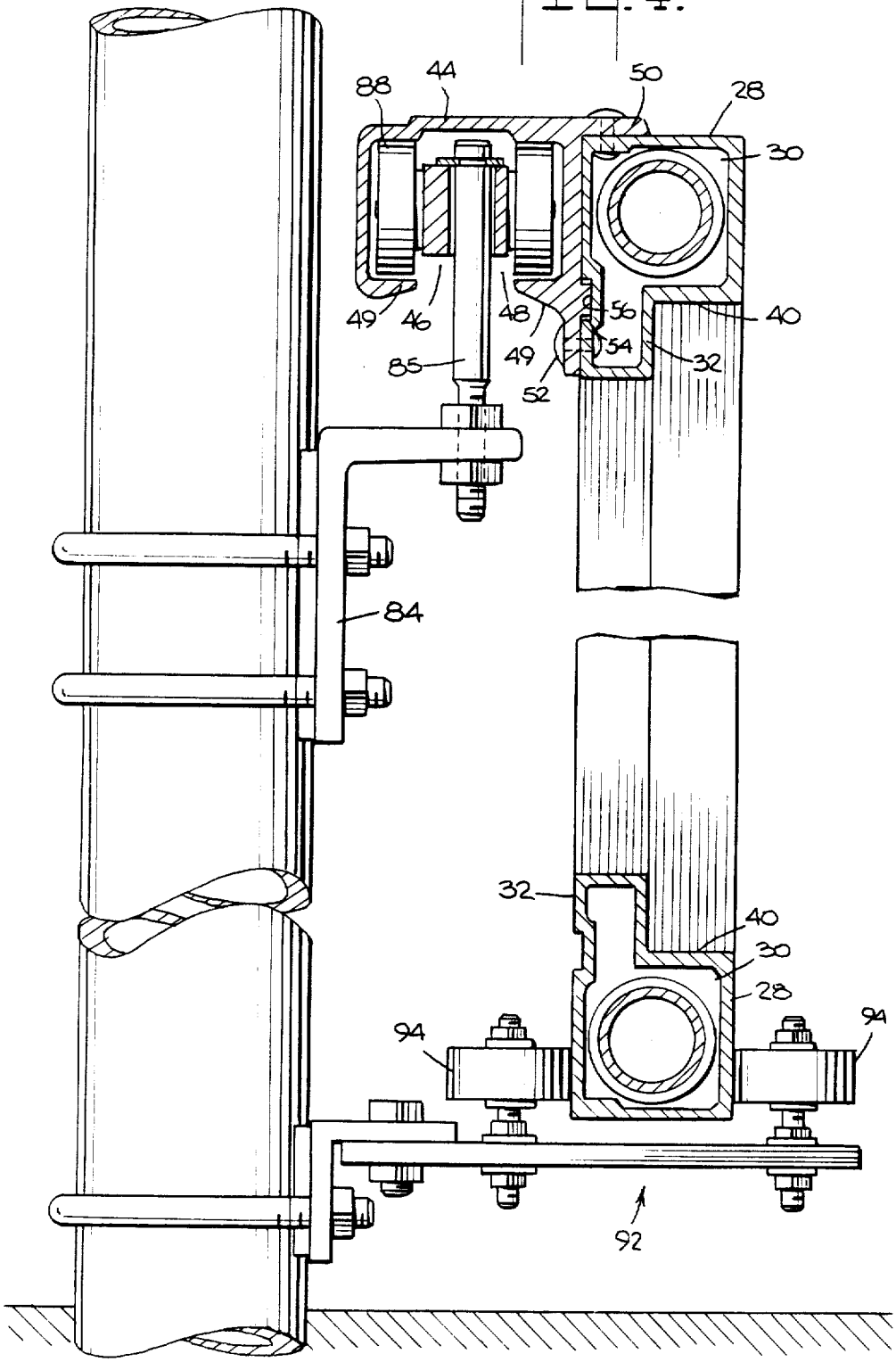
FIG. 4 is a cross-section taken on plane IV—IV of FIG. 2.
Figure 5:
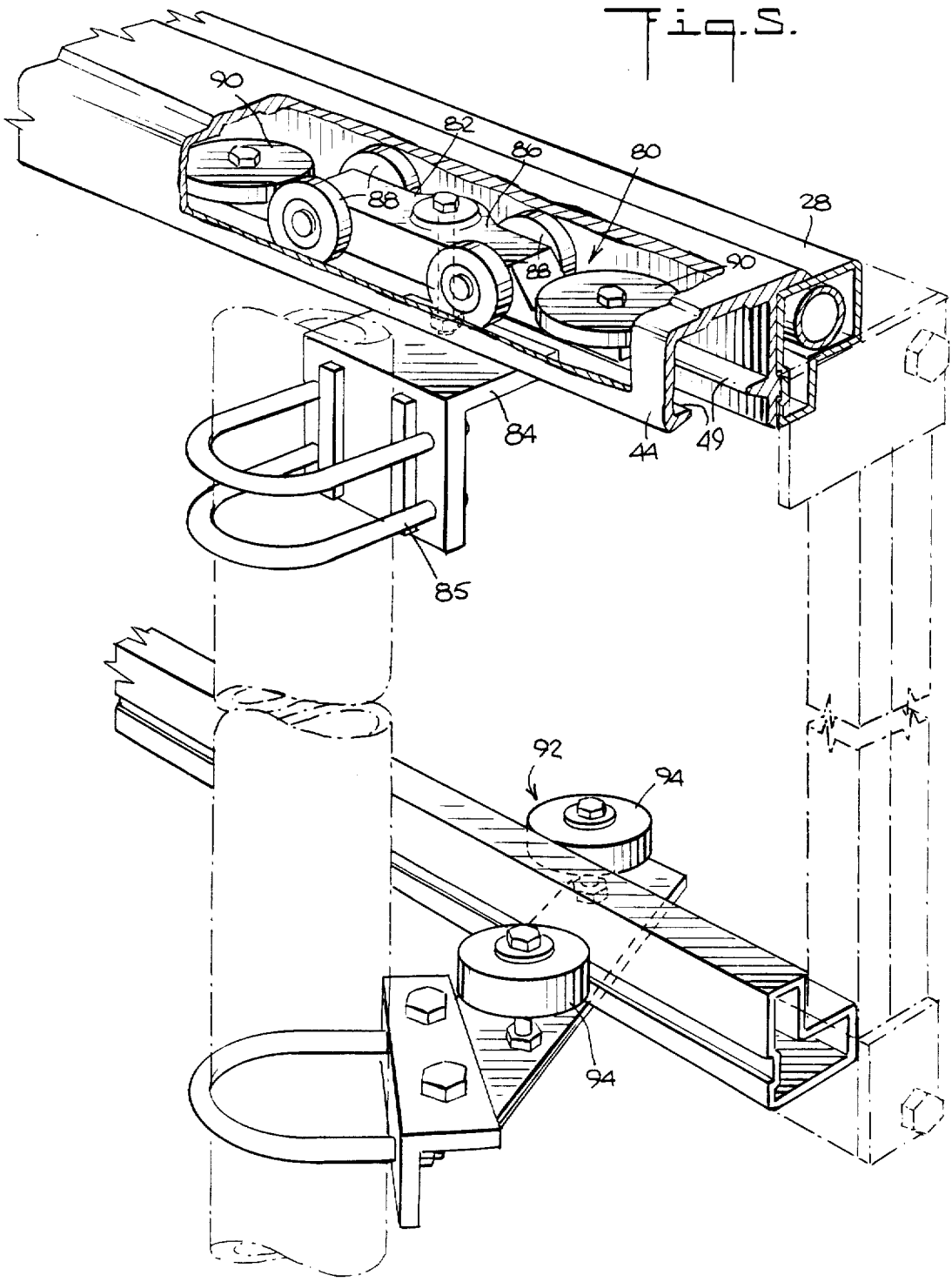
FIG. 5 is a detail perspective of a portion of the embodiment seen in FIG. 1.

A track assembly 44 is secured to the upper horizontal member, extending the entire width of the gate assembly. This assembly, seen in FIGS. 4 and 5, is generally in the form of the letter "C", lying with the open side facing downward. The interior of the track is a channel 46 with a slot 48 opening downwardly, defined by flanges 49, which extend inwardly from the vertical sides of the track assembly. Horizontal and vertical mounting flanges 50 and 52, respectively, extend from adjacent outer corners of the track, dimensioned to overlap the mounting leg and upper face of the horizontal member 28, secured thereto by suitable means, such as rivets. An indexing groove 54 on the horizontal member and a corresponding indexing land 56 on the mounting flange may be provided to assist in positively engaging these parts during assembly.

It has been found advantageous to provide track assembly in lengths different from the lengths of the various panel elements. This arrangement allows points where two panel assemblies abut to be overlapped by solid portions of track assembly, and vice versa, leading to greater structural rigidity.

Vertical stability is enhanced by provision of cables 98, extending diagonally between top and bottom horizontal members, preferably criss-crossed as shown in FIGS. 2 and 3. For cables terminating at end members, eyebolts 100, carried on struts 101 may be provided. At intermediate points, pads 102 may be secured to the horizontal members, preferably spaced between support members. If a gate is of sufficient width that some cables have both ends terminated at pads, e.g., cables 99, FIG. 2, turnbuckles (not shown) may be provided to allow the cables to be tightened, as known to those in the art.

Figure 6:
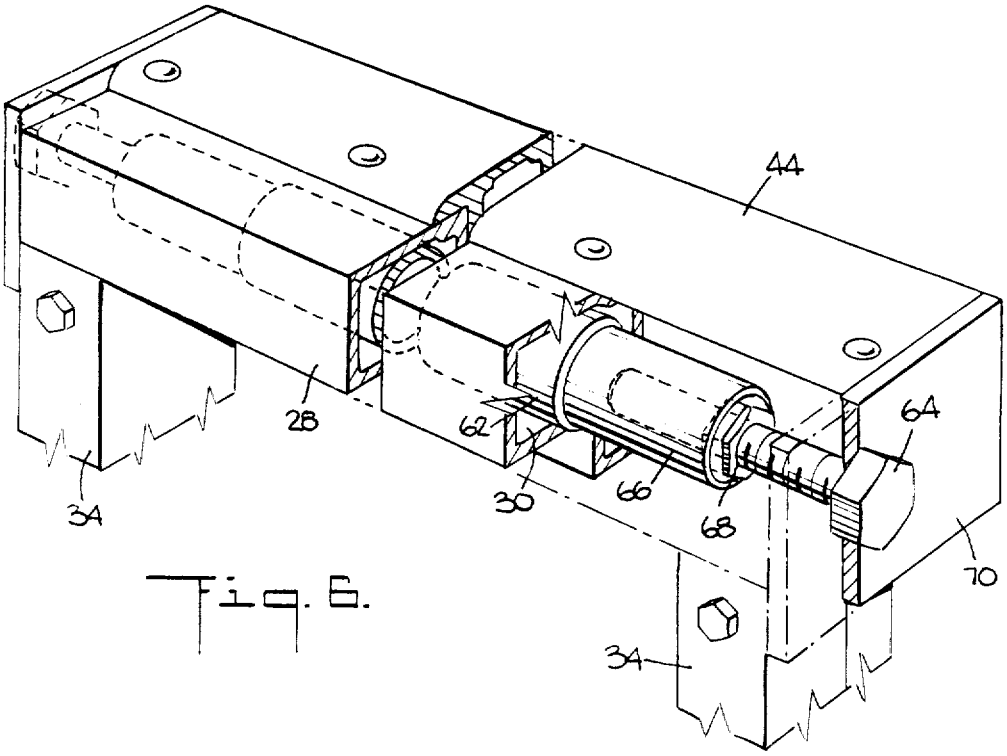
FIG. 6 is a detail perspective of a portion of the embodiment of FIG. 1.

The ultimate structural rigidity provided by the present invention, however, is obtained by employing post-tensioning assemblies, seen in FIG. 6. This assembly includes a tubular. member, such as rod 62, dimensioned to fit snugly but slidable within the central passage 30 formed in a horizontal member. The rod carries a threaded receiver 68 in its extreme tips. Suitably, the rod may be formed from commonly-available thin-walled tubing pipe; in the embodiment shown, a 1⅝ inch O.D. pipe has been found to provide excellent results, and offers the advantage of using readily-available materials. A specially-constructed rod, utilizing a material of exceptional strength/weight ratio, such as graphite, could offer improved performance, albeit at higher cost. The threaded receiver 68 may be a nut and the 24 end section of the rod may be adapted to carry the nut by providing a tip section 66 within the larger pipe 62. A 1⅝ inch O.D. pipe, inserted into the larger pipe and welded in place, has been found suitable. Similarly, the nut preferably is dimensioned to accept a ¾ inch bolt 64; the nut preferably is inserted in the end of the tip and welded in place.

Clearly, the ease of transporting materials for gates according to the present invention would be somewhat negated if the post-tension assembly had to be fabricated in a single piece. Yet, this assembly must be an integral unit in order to function. The solution to this dilemma is to employ multiple, shorter sections of 1⅝ inch O.D. pipe, joined by sections of 1⅜ O.D. inch pipe, all welded together to produce a single, integral element.

Thus, rather than manufacturing and transporting a very long element, it is possible quickly and readily to fabricate a very long post-tension assembly (for example such an assembly to span a 30-foot gap, including the length of the counterbalance panel, would be over 44 ft. wide), using readily-available apparatus, at the installation location. Length of the assembly should be controlled during fabrication so that each of the threaded receivers is recessed a short distance, for example about 2 inches, from each end of the horizontal member.

Two post-tension assemblies are fabricated, and they are inserted into the passages 30 in the upper and lower horizontal members 28. End plates 70, dimensioned to fit over the ends of the horizontal members, are placed over the openings, and bolts 64 are inserted through apertures in the end plates and threaded onto the nuts 68. The end plates are preferably aluminum, about ½ inch thick. The bolts are tightened to provide about several hundred pounds of force. No need exists, however, to gauge the force applied with precision; the bolt is tightened until the gate becomes laterally straight. In this manner, the post-tension rod is placed in tension, and that force is transmitted to the horizontal members through the end plates as a compressive force. It has been found most effective to perform final tightening of the post-tensioning bolts after the gate is installed, to achieve the straightest possible assembly. This operation is performed in conjunction with final tightening of the cables 98 and 99, to achieve both lateral and vertical alignment.

It has been found that camber problems in relatively wide gates can be avoided by pre-bending the horizontal members. After the initial assembly of the horizontal members, each is bent slightly in the horizontal plane (i.e., the plane parallel to the ground after installation) to form a shallow arc. Post-tensioning straightens the horizontal members, and the resulting balance of the stresses resists the twisting moment at the end of the gate. Thus, difficulties with camber are eliminated without adding stiffening material.

After assembly, the completed gate is mounted on the vertical support means, as seen in FIG. 2. Each vertical support includes slide means 80, best seen in FIG. 5, each of which engages the track assembly to permit easy sliding movement. As shown, the slide means is a truck assembly 82, one of which is carried on each vertical support, mounted on a bracket 84 secured to the top of same by bolts 85. The truck assembly is well-known to the art, and includes a body 86, four vertical rollers 88, and two horizontal rollers 90, all journaled to the body for rotation, and preferably also includes sealed bearings for ease of maintenance. The vertical rollers bear against the inner sides of flanges 49 or the inner surface of the top face of the track 44, and the horizontal rollers bear against the inner surfaces of the sides of the track. Of course, sufficient clearance is provided so that each roller only bears against one of these respective surfaces at a time. Thus, the gate assembly may slideably move with great ease, yet substantial transverse motion, either horizontal or vertical, is prevented.

A guide roller assembly 92, also mounted on each vertical support, bears none of the weight of the gate assembly, but restrains horizontal movement of the bottom of the gate by engaging the outer sides of the bottom horizontal member with horizontal rollers 94.

As seen in FIG. 2, the panels may be provided with chain-link mesh 96 or other suitable materials, if desired. Suitable gate accessories, seen in FIGS. 2 and 3, may also be provided, such as a support roller 104, and a latch 106, carried on the fence post at the far side of the gap, or on other suitable means. Support rollers can be provided on the counterbalance side of a gap and are particularly suitable for gates spanning gaps over 20 feet in width. Also, a barbed wire assembly 108 can be carried atop the gate member if required. These and other accessories will be appreciated and can be implemented by those having skill in the art.

Once mounted on the vertical supports, the gate operates by sliding between open and closed positions, spanning the gap. Gate motion can be actuated manually, or by a suitable motor mechanism, controlled either directly or remotely, as known to the art. The entire weight of the gate, including both the vector and moment components, is transmitted by the truck assemblies to the vertical supports. The post-tensioning devices provide an increased stiffness to the structure, permitting the use of very light materials, capable of spanning relatively wide gaps.

The use of light-weight materials, heretofore unsuitable for long gates, is but one of the advantages afforded by the present invention. In addition, transportation problems associated with the prior art gates are avoided completely. Moreover, repair of gates is greatly facilitated. Heretofore, major repair of a long, cantilever gate required returning the gate to the manufacturer. Not only does that process repeat the transportation difficulties associated with such gates, but also the user lacks security during the long period required in moving the gate back and forth and repairing same. The present invention permits onsite repairs, at most necessitating replacement of one or more panel sections. Also, heretofore it has not been possible to adjust the camber of a wide gate without adding stiffening members. By varying the amount of post-tensioning force, misalignment can be corrected and camber eliminated. Moreover, manufacture of such gates is facilitated, as the necessity for custom-manufactured gates is eliminated. Thus, panel sections can be produced in a highly efficient manner, and scheduling is greatly simplified.

It should particularly be noted that the present invention is adaptable to a wide variety of gate types, notwithstanding the preferred cantilever sliding gate depicted herein. Swing gates, vertical gates, telescoping gates, and others may be constructed according to the present invention.

It will be understood by those in the art that various modifications can be introduced without departing from the scope of this invention. For example, in addition to the panel types described, a pedestrian door could be provided as an attachment to the end panel. In this manner, pedestrians could use this door to gain access without having to open the gate. These and other modifications can be made without departing from the scope of the present invention, which is defined solely by the claims appended hereto.

I claim:

1. A planar gate structure having a height dimension and a width dimension for spanning at least a predetermined gap, the gate structure comprising:

a plurality of separate rectangular panels assembled edge-to-edge in a common plane to provide said width dimension of the gate structure, each panel having an elongated top member, an elongated bottom member, and means for spacing the top and bottom members apart by a distance approximately equal to said height dimension, each top and bottom member being formed with a longitudinally extending through passage, and the panels being arranged so that all the top members and all of the bottom members are aligned;

means for connecting adjacent panels together;

a first elongated tension member extending the width dimension of the gate through the passages of the top members of all the plurality of panels;

a second elongated tension member extending the width dimension of the gate through the passages of all the bottom members of the plurality of panels; and means for post-tensioning the first and second tension members so as to apply predetermined compression forces on the respective upper and lower members sufficient to prevent camber of the gate assembly when the gate is cantilevered to span said predetermined gap.

2. A gate structure according to claim 1 wherein each of the first and second tension members comprises a hollow rod having an internally threaded receiver at at least one end, and the means for post-tensioning each of the first and second tension members comprises a bearing member and an externally threaded bolt having a head, the bolt being threaded into the receiving means, and the bearing member being disposed between one end of the corresponding aligned top or bottom members and the head of the bolt for translating tensile force in the tension member to compression force in the respective top or bottom members.

3. A gate structrue according to claim 1 wherein the means for spacing the top and bottom members of each panel apart comprises a plurality of vertical members, each vertical member having an upper end secured to the top member and a lower end secured to the bottom member.

4. A gate structure according to claim 3 wherein each top and bottom member comprises, in cross section, a square box portion defining said passageway and a second portion extending from a face of the box portion toward the other one of the top and bottom members, the second portion being located on only one side of the panel, such that the cross section of each member has a generally P shape.

5. A gate structure according to claim 4 wherein the means for connecting adjacent panels together comprises at least one elongated track member extending adjacent to said one side of each panel and detachably fastened to the top members of the plurality of rectangular panels, the track member bridging at least one joint between adjacent panels to augment the stiffness of the gate structure.

6. A planar cantilever gate structure for spanning a predetermined gap, the gate structure having a height dimension and a width dimension and comprising:

a plurality of separate rectangular panels assembled edge-to-edge in a common plane to provide said width dimension of the gate structure, each panel having an elongated top member, an elongated bottom member, and means for spacing the top and bottom members apart, each top and bottom member having a cross section comprising a first box portion defining a through passage and a second portion extending from the first portion on only one side of the panel, and each top and bottom member having a preset slight curvature in a plane perpendicular to the gate, the panels being arranged so that all of the top members are aligned and all of the bottom members are aligned;

means are connecting adjacent panels together;

a first elongated tension member extending the width dimension of the gate through the passages of the top members of all the plurality of panels;

a second elongated tension member extending the width dimension of the gate through the passage of the bottom members of all the plurality of panels; and means for post-tensioning the first and second tension members so as to apply compression forces on the respective top and bottom members sufficient to straighten the preset curvature of said members.

7. A gate structure according to claim 6 wherein each of the first and second tension members comprises a hollow rod having an internally threaded receiver at at least one end, and the means for post-tensioning each of the first and second tension members comprises a bearing member and an externally threaded bolt having a head, the bolt being threaded into the receiving means, and the bearing member being disposed between one end of the corresponding aligned top or bottom members and the head of the bolt for translating tensile force in the tension member to compression force in the respective top or bottom members.

8. A gate structure according to claim 6 wherein the means for spacing the top and bottom members of each panel apart comprises a plurality of vertical members, each vertical member having an upper end secured to the top member and a lower end secured to the bottom member.

9. A gate structure according to claim 8 wherein the first box portion of each top and bottom member comprises, in cross section, a square box portion, and the second portion is located on one side of the panel, such that the cross section of each member has a generally P shape.

10. A gate structure according to claim 9 wherein the means for connecting adjacent panels together comprises at least one elongated track member extending adjacent to said one side of each panel and detachably fastened to the top members of the plurality of rectangular panels, the track member bridging at least one joint between adjacent panels to augment the stiffness of the gate structure.

11. A gate structure according to claim 10 wherein the elongated track member comprises an inverted channel portion having one side abutting against the one side of the top member; a flange extending laterally from the one side of the inverted channel and overlying at least a portion of the upper surfaces of the top members of at least two panels; and means for detachably fastening the flange to the upper surfaces of said top members.

12. A gate structure according to claim 11 wherein the track member comprising an additional flange extending downward from the one side of the inverted channel portion, and means for detachably fastening the additional flange to the second portion of the top member.

13. A gate structure according to claim 12 wherein the one side of each of the top members and the abutting side of the at least one track member are formed with interengaging groove and land means for positively engaging the track member with the top members during assembly of the gate structure.

14. A method of assembling a planar gate structure, the method comprising:

providing a plurality of unitary rectangular panels, each panel having a top member and a bottom member each with a through passage parallel to the panel; assembly the plurality of panels edge-to-edge with the through passages of the top members and the through passages of the bottom members in alignment;

inserting a first tension through the through passages of the top members of all the panels;

inserting a second tension member through the through passages of the bottom members of all the panels; and post-tensioning the first and second tension members so as to apply sufficient compression forces on the respective aligned top members and aligned bottom members to prevent camber of the gate structure when the assembly is cantilevered from a position spaced from a free end of the structure.

* * * * *

UNITED STATES PATENT AND TRADEMARK OFFICE

CERTIFICATE OF CORRECTION

PATENT NO. : 4,723,374

DATED : 9 February 1988

INVENTOR(S) : Douglas C. PETERSON et al.

It is certified that error appears in the above-identified patent and that said Letters Patent is hereby corrected as shown below:

Col. 6, line 45: delete the numeral "24".

Col. 8, line 26: change "onsite" to -- on-site --.

Col. 9, line 26: change "structrue" to -- structure --.

Col. 10, line 51: change "comprising" to --comprises --.

Col. 10, line 67: after "panel;" insert paragraph; change "assembly" to -- assembling --.

Signed and Sealed this

Twenty-first Day of June, 1988

*Attest:*

*Attesting Officer*

DONALD J. QUIGG

*Commissioner of Patents and Trademarks*